US006131908A

United States Patent [19]

Palmer

[11] Patent Number: 6,131,908

[45] Date of Patent: Oct. 17, 2000

[54] METHOD OF PLAYING A CASINO-TYPE CARD GAME

[76] Inventor: James G. Palmer, 2311 Walgrove Ave., Los Angeles, Calif. 90066

[21] Appl. No.: 08/891,863

[22] Filed: Jul. 9, 1997

Related U.S. Application Data

[60] Provisional application No. 60/024,849, Aug. 28, 1996.

[51] Int. Cl.[7] ..... A63F 1/00

[52] U.S. Cl. ..... 273/292

[58] Field of Search ..... 273/292, 274, 273/309; 463/12, 13

[56] References Cited

U.S. PATENT DOCUMENTS

| | | | |
|---|---|---|---|
| 5,154,429 | 10/1992 | LaVasseur | 273/292 |
| 5,328,189 | 7/1994 | Malek | 273/292 |
| 5,377,993 | 1/1995 | Josephs | 273/292 |
| 5,494,295 | 2/1996 | Potter et al. | 273/292 |
| 5,615,888 | 4/1997 | Lofink | 273/292 |
| 5,660,393 | 8/1997 | Dreger | 273/292 |

OTHER PUBLICATIONS

Scarn's Encyclopedia Of Games, John Scarne, Harper & Row Publishers, "Banking Card Games", pp. 276–282, 1973.

*Primary Examiner*—Benjamin H. Layno

[57] ABSTRACT

A modified method of playing two casino-type card games, Twenty-One (Blackjack) and Stud Poker, where a player exercises the option to play either Twenty-One or Stud Poker upon receipt of their cards. To begin, players place an ante to be eligible to participate in the game of Twenty-One. Players may place a second optional ante making them eligible to participate in the game of Stud Poker. Each player and the dealer is dealt two cards, with at least one of the dealer's "community cards" turned face-up. Players evaluate their cards to determine which one of the two games they will elect to play. If the player determines the most beneficial method of play is Twenty-One then the player forfeits the second optional ante and is subject to the rules associated with the game of Twenty-One as it is commonly played. If the player determines the most beneficial method of play is Stud Poker then the player receives one additional card only, giving the player a total of three cards. The player now has a new Stud Poker ante equal to the cumulative sum of the Twenty-One ante and the second optional ante. If one or more players elect to play Twenty-One, then, the dealer deals them additional cards, or "hits," placing "hit" cards in a designated area, separate from the original two "community cards." The dealer will continue to "hit" until casino rules are satisfied. If all players elect to play Stud Poker, then the dealer does not "hit," and turns the face-down card to the up position. The dealer determines if the Twenty-One player has a winning hand and pays this player accordingly. The dealer determines if the Stud Poker player has a winning hand by comparing the dealer's two "community cards" with each player's three cards, (giving each Stud Poker player a total of five cards). Successful poker antes will be paid according to a preset schedule. All unsuccessful antes will be collected.

5 Claims, 4 Drawing Sheets

METHOD OF PLAYING A CASINO-TYPE CARD GAME

BACKGROUND—CROSS REFERENCES TO RELATED APPLICATIONS

This method of card play references my provisional application 60/024,849 filed Aug. 28, 1996.

BACKGROUND—FIELD OF INVENTION

This method relates generally to wagering-type card games, specifically to Twenty-One (Blackjack) and Stud Poker.

BACKGROUND—DESCRIPTION OF PRIOR ART

The conventional game of Twenty-One consists of a plurality of players competing in a game of chance with a dealer. The object is for each player to achieve a total card count closer to, yet not exceeding, a count of 21 than that of the dealer. The conventional game of Stud Poker consists of a plurality of players either competing against each other, or competing against a dealer in an attempt to achieve a predetermined combination of cards. Some card games allow players different methods of play and/or payout for certain combinations of cards i.e. Spanish 21 U.S. Pat. No. 5,615,888 to Lofink 1996, Multiple Action Blackjack U.S. Pat. No. 5,154,429 to LeVasseur 1992. Other games allow players to increase the ante whenever it is advantageous for them to do so, U.S. Pat. No. 5,377,993 to Josephs 1994. These games either limit the player's options by allowing them only one game selection at a time, or limit the house odds by allowing the players to increase their wager during advantageous situations.

OBJECTS AND ADVANTAGES

The present invention is a modified version of the card game Twenty-One. The new method of play is characterized by giving players multiple options from the onset of the game, whether they elect to only play Twenty-One, or wish to have the option of playing Stud Poker should the opportunity arise. Based on the wagering system of this new method of play, players place a single ante to participate in the game of Twenty-One. The Twenty-One player only receives payouts in accordance with Twenty-One as it is currently played. Players may also place a second (optional) ante to participate in the game of Stud Poker. Players who elect to play Stud Poker may get a return on their wagers up to 1000:1 whenever they form a predetermined Poker hand consisting of the player's cards and certain ones of the dealer's cards. This new method of play allows for more player interaction than the current game of Twenty-One, by allowing the player to exit from the rules and limited payouts of Twenty-One as it is currently played, and enter the rules of Stud Poker. While allowing Stud Poker players to be more comfortable than the current method of playing Stud Poker, since they are not competing with either the house or other players but simply form a predetermined Poker hand consisting of the player's cards and certain ones of the dealer's cards. The new method of play allows for greater player interaction and greater payouts.

SUMMARY OF INVENTION

This new method of play is a modified version of the game of Twenty-One, characterized by allowing players to place a second (optional) ante so they may divorce themselves completely from the current rules of the game of Twenty-One, and begin playing Stud Poker should the player's judgement and skill determine that the move is warranted. The method of play will consist of a plurality of players and a dealer using one or more decks of playing cards.

DETAILED DESCRIPTION—DESCRIPTION OF THE MAIN EMBODIMENT

Figure 1:
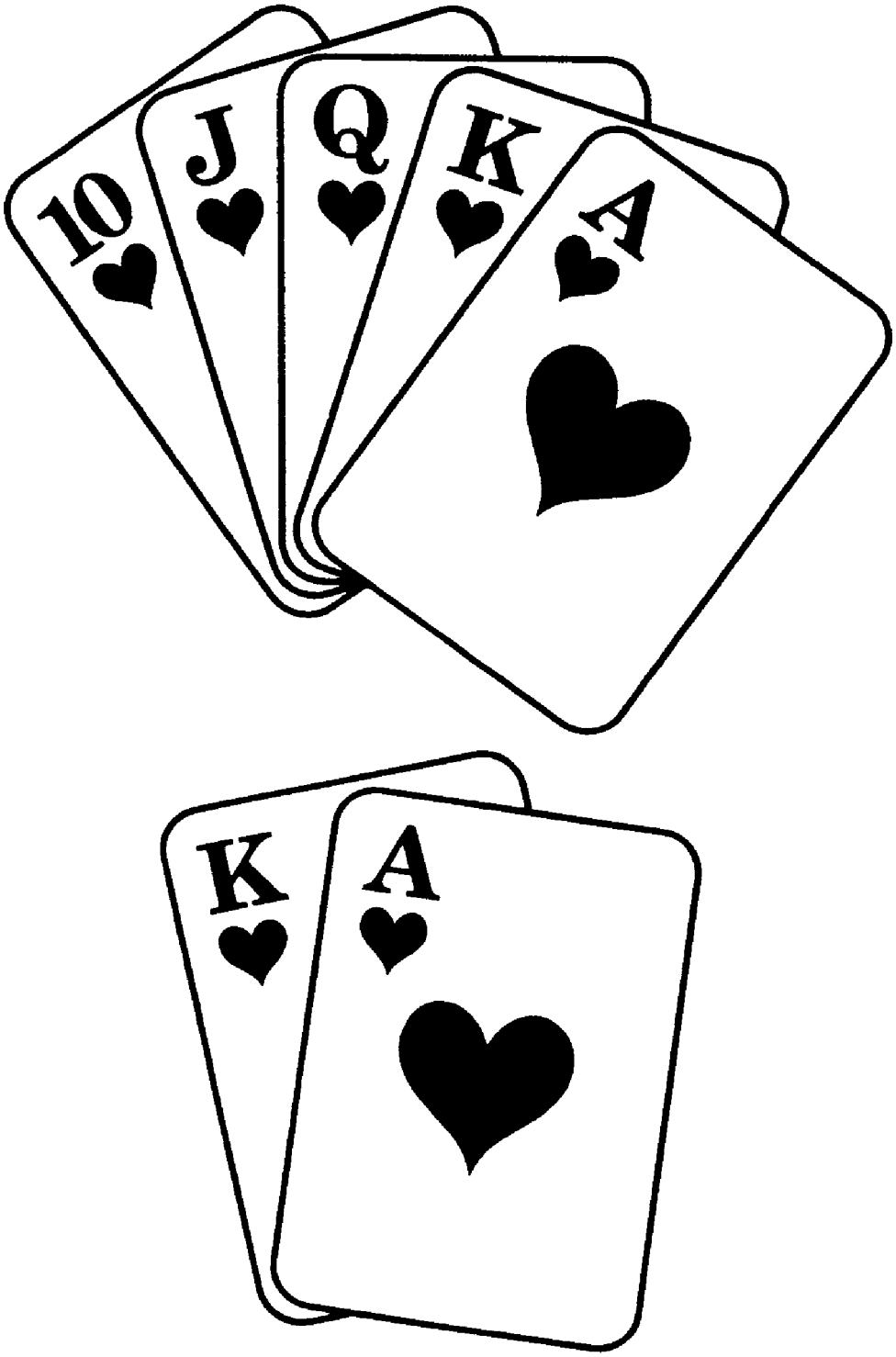
FIG. 1 shows the player's play position.
Figure 3:
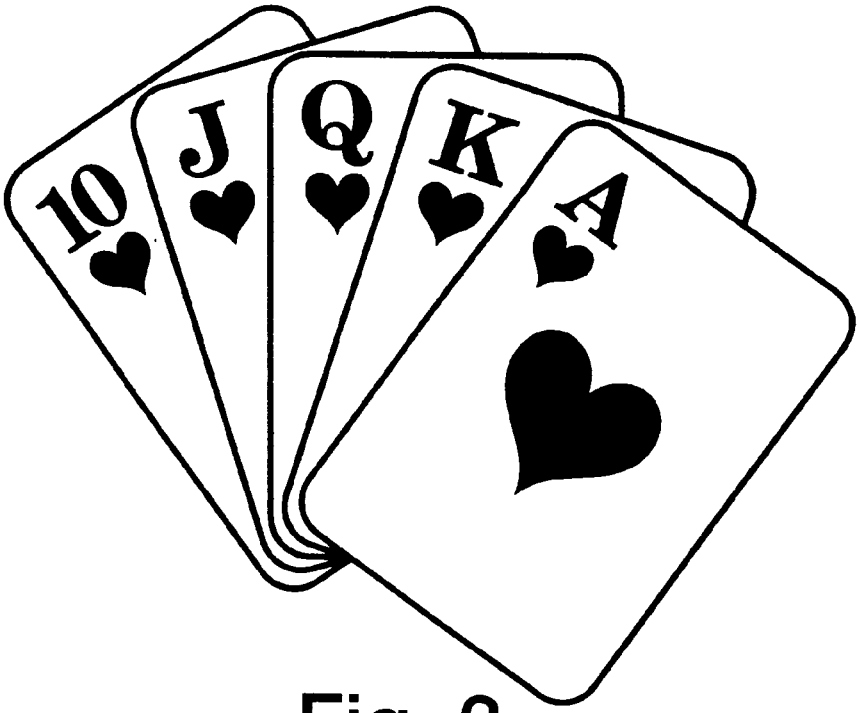
FIG. 3 shows the player's optional ante position.
Figure 2:
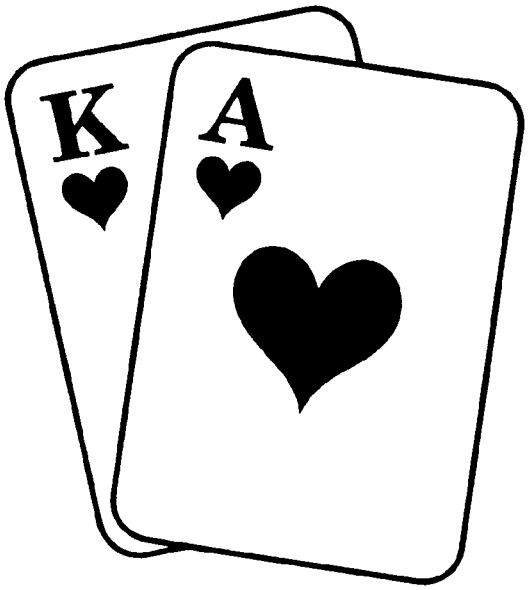
FIG. 2 shows the player's Twenty-One ante position.
Figure 4:
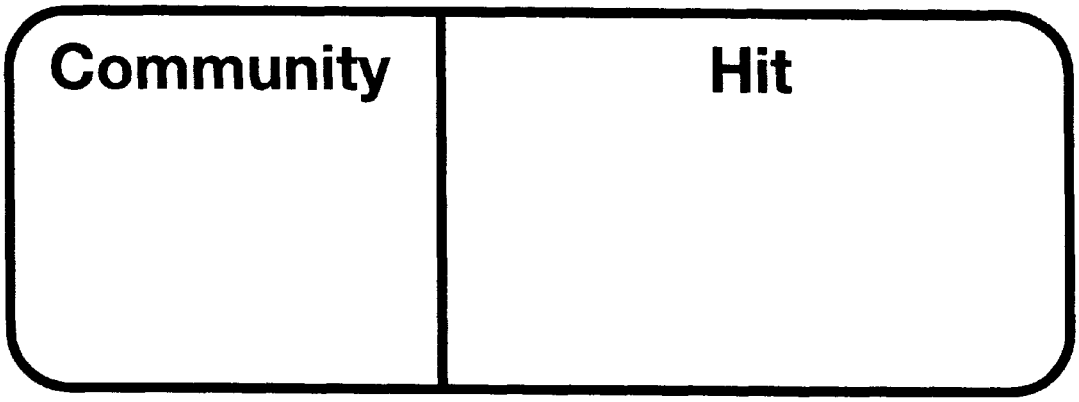
FIG. 4 shows the dealer's play position.
Figure 5:
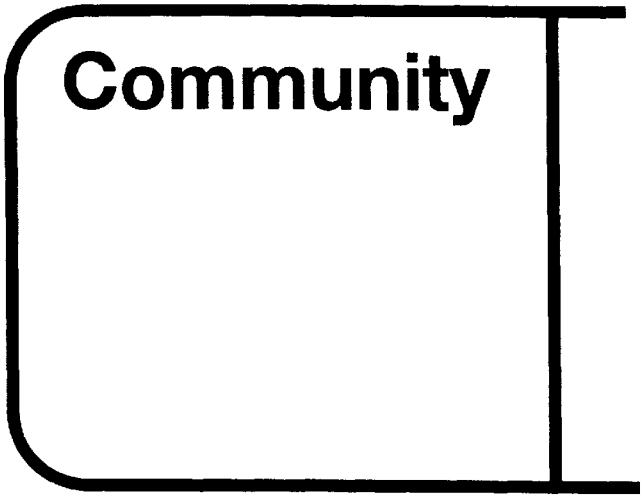
FIG. 5 shows the dealer's "Community Card" position.

In the preferred embodiment this new method of play consists of a plurality of players, a live dealer and a single deck of cards. Each player being required to place an initial ante to participate in the game of Twenty-One, and place a second (optional) ante should the player wish to divorce themselves completely from the game of Twenty-One, and begin playing Stud Poker should the player's judgement and skill determine that the move is warranted. All antes must be placed before the distribution of cards and may not be placed retroactively. After all players have placed their antes, the dealer will, in a rotational manner, deal two cards face down to each player, and two cards to the dealer in a rotational manner, placing the dealer's "community cards" in the "community" box (FIG. 5), with at least one of the dealer's "community cards" turned face-up. If the dealer's face-up card is an Ace, the following options will be offered, in a rotational manner, to each player: 1) Players whose cards equal 21 (Ten card plus an Ace card, a "natural") may elect to be paid "even money" and will have the total sum of both the original ante and the optional ante (if placed) paid at 1:1. 2) Elect to play Stud Poker (provided the optional ante was placed) and receive one additional card only. 3) Elect to insure. Players may insure either the Twenty-One ante or both antes. 4) Take no action and wait until the dealer has determined if a dealer natural exists. If the dealer's two "community cards" total 21 (ten card plus an ace card, a "natural") then the dealer will, in a rotational manner: 1) Tie ("push") any player who may still be holding a "natural" and did not take "even money." 2) Pay out any "insurance" wagers according to the current method of play. 3) Compare the dealer's "community cards" with the cards of players who elected to play Stud Poker (giving a total of five cards) to determine if a valid Poker hand exists. Valid Poker hands will be paid according to the following preset pay-out schedule:

| Pay-Out Schedule | |
|---|---|
| Royal Flush | 1000:1 |
| Straight Flush | 200:1 |
| Four of a Kind | 50:1 |
| Full House | 11:1 |
| Flush | 8:1 |
| Straight | 5:1 |
| Three of a Kind | 3:1 |
| Two Pair | 2:1 |
| Pair of 10's or better | 1:1 |

-continued

| Pay-Out Schedule | |
|---|---|
| Blackjack (Natural) | 3:2 |
| Winning Blackjack Hand | 1:1 |
| Insurance Wager | 2:1 |
| Even Money | 1:1 |

Figure 6:
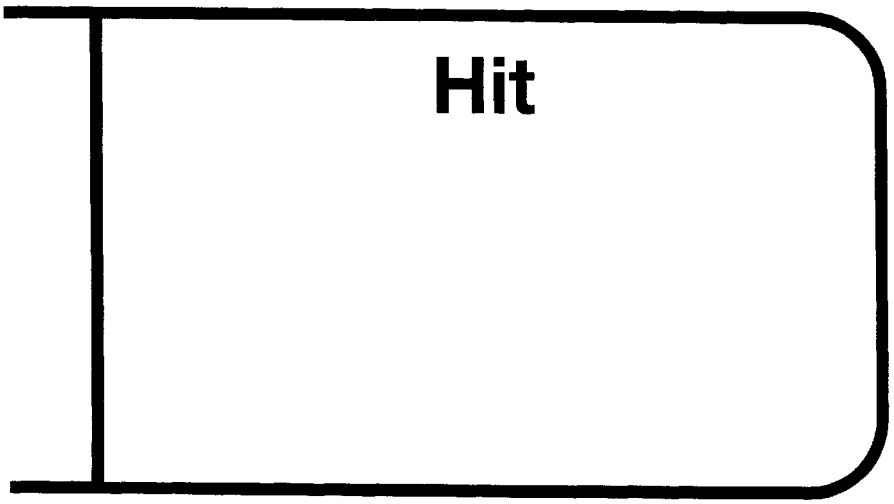
FIG. 6 shows the dealer's "Hit Card" position.

All remaining antes are to be collected. The cards are to be shuffled and the game now restarts from the beginning. If the dealer's two "community cards" do not total 21 then the dealer will collect all "insurance" wagers. The game will continue from this point. Players who placed only one ante will continue to play, and receive payouts, according to rules of Twenty-One as it is currently played. Players who placed both the original ante and the second (optional) ante who choose Twenty-One as their preferred game, will forfeit the second (optional) ante and will continue to play, and receive payouts, according to rules of Twenty-One as it is currently played. Players who placed both the original ante and the second (optional) ante who choose Stud Poker as their preferred game, will be dealt one additional card, (giving a total of three cards). The player's new ante is the cumulative sum of the original ante plus the second (optional) ante. When all players have exercised their options, the dealer will turn over the face down card. If all players choose Stud Poker as their preferred game the dealer will not take new cards ("hit"). The dealer will compare the dealer's two "community cards" with each of the player's three cards, (giving a total of five cards), to determine if a valid Poker hand exists. Valid Poker hands will be paid according to the preset pay-out schedule. If one or more players choose Twenty-One as their preferred game the dealer will take new cards ("hit") his hand until casino rules are satisfied (i.e., hit 16, stand on 17), placing all new cards in the "hit" box FIG. 6. When casino rules are satisfied, or if the dealer's hand exceeds the total sum of 21 ("busts") the dealer will, in a rotational manner: 1) Compare the dealer's hand with each player's hand and will pay winning Twenty-One players according to the rules of Twenty-One as it is currently played. 2) Compare the dealer's two "community cards" with each of the Stud Poker player's three cards (giving a total of five cards) to determine if a valid Poker hand exists. Valid Poker hands will be paid according to a preset schedule. If the dealer's face-up card is a ten value card (i.e. Ten, Jack, Queen or King) and the dealer is required to look under it to see if there is an ace, (Peek), and the dealer has a total sum of 21 (ten card plus and ace, a "natural") then all antes will be collected. If the dealer is not required to peek and it is later determined that the dealer has a total sum of 21 (ten card plus and ace, a "natural") the dealer will, in a rotational manner: 1) Tie ("push") any player who may still be holding a "natural" and did not take "even money." 2) Pay out any "insurance" wagers according to the current method of play. 3) Compare the dealer's "community cards" with the cards of players who elected to play Stud Poker (giving a total of five cards) to determine if a valid Poker hand exists. Valid Poker hands will be paid according to the preset pay-out schedule. All remaining antes are to be collected according to the current rules of Twenty-One. The cards are to be shuffled and the game now restarts from the beginning. Players will receive a payout in either Twenty-One or Stud Poker, but will not be paid in both games. Players may not change their preferred game during the current hand.

OPERATION—DESCRIPTION OF THE MAIN EMBODIMENT

The distribution of cards and primary wagering procedures are identical to the game Twenty-One as it is currently played, namely, the player must make a wager in order to receive two cards and participate in the gaming, procedures. However, with the placement of a second (optional) wager, the player now has the option of divorcing themselves from the rules and payouts of the game of Twenty-One and playing Stud Poker.

DESCRIPTION AND OPERATION—ALTERNATE EMBODIMENT

Although the preferred method of play has been described above with reference to playing cards, it should be understood that multiple decks of playing cards can also be used by having the dealer reshuffling the deck whenever the "cut card" is reached rather than at the end of each round of play, and have the same effect on the game.

DESCRIPTION AND OPERATION—ALTERNATE EMBODIMENT

Although the preferred method of play has been described above with reference to one of the dealer's cards being turned up, it should be understood that either both or none of the dealer's cards may be turned up, prior to the players choosing, their game, and have the same effect on the game.

DESCRIPTION AND OPERATION—ALTERNATE EMBODIMENT

Although the preferred method of play has been described above with reference to the cards being distributed to the players in a face-down manner, it should be understood that either one or all of the cards may be distributed in a face-up manner, and have the same effect on the game.

DESCRIPTION AND OPERATION—ALTERNATE EMBODIMENT

Although the preferred method of play has been described above with reference to playing cards and a live dealer, it should be understood that the method of play may also be practiced with a dealer substitute and card substitutes and have the same effect on the game. That is, the game may be played against a dealer or the like, e.g., a programmed computer or other apparatus, and with playing cards or the like, e.g., symbols on the display of a computer or other apparatus, and have the same effect on the game.

DESCRIPTION AND OPERATION—ALTERNATE EMBODIMENT

Although the preferred method of play has been described above with reference to betting and payout procedures, it should be understood that in addition to the above antes, a jackpot ante can be placed allowing for jackpot payouts to players who receive a predetermined arrangement of cards, and have the same effect on the game.

DESCRIPTION AND OPERATION—ALTERNATE EMBODIMENT

Although the preferred method of play has been described above with reference to the preset pay-out schedule, it should be understood that alterations to the payout schedule can be made, and have the same effect on the game.

DESCRIPTION AND OPERATION—ALTERNATE EMBODIMENT

Although the preferred method of play has been described above with reference to the preset poker pay-out schedule, it should be understood that poker players may only be allowed to receive a total aggregate payout amount. The aggregate payout will be at the discretion of each playing venue, and have the same effect on the game.

DESCRIPTION AND OPERATION—ALTERNATE EMBODIMENT

Although the preferred method of play has been described above with reference to the Twenty-One pay-out schedule, it should be understood that Twenty-One players may receive a payout whenever they hold a predetermined arrangement of cards, (i.e. 7-7-7 or 6-7-8 not necessarily of the same suit), and have the same effect on the game, and have the same effect on the game.

DESCRIPTION AND OPERATION—ALTERNATE EMBODIMENT

Although the preferred method of play has been described above with reference to the player electing to receive "even money" payouts on both antes when the dealer has an Ace card showing, see the preset pay-out schedule, it should be understood that only the Twenty-One ante may be paid while allowing for the player to recapture the second ante with no payout.

CONCLUSION, RAMIFICATIONS, AND SCOPE

Accordingly, players will have greater control over their gaming experience play, and may now participate in more than one game at the same table. Players will also have greater control over their gaming dollars, and will have a greater level of comfort, since they may alternate between games at their leisure. Furthermore, casinos will benefit from this new method of play since players will remain at gaming tables for longer periods of time without losing interest.

What is claimed is:

1. A method for a player and a dealer, or representation thereof, to play a modified version of the game of twenty-one using at least one standard deck of playing cards, or representation thereof, in the conventional manner of play of twenty-one with various rule modifications comprised of the following steps:

a) said player placing an initial wager, giving said player the option to place a card-wager on playing a first card game the combined numerical total of card values in a player's hand and in a dealer's hand is compared, and b) said player optionally placing an additional optional wager, giving said player the option to place an optional card-wager on playing a second card game wherein a combination of card values in a combined player's hand and dealer's hand is compared to a range of predetermined poker hand sets, and c) dealing after all wagers have been placed, the dealer then a first player card, a first dealer community card, a second player card, a second dealer community card, at least one of said dealer's community cards is face up whereby the value of one of said dealers community cards is not immediately revealed, and d) said player combining said players first card and said players second card to form an initial players hand, said dealer combining said dealers first community card and said dealers second community card to form an initial dealers community hand, e) said player viewing the card values of the dealer's face up card and the card values of said initial player's hand;

f) if said player did not place said additional optional wager, requiring said player to continue to play only said first game;

g) if said player placed said additional optional wager, providing said player the option of deciding whether to continue playing only the first card game, or deciding not to play said first card game and deciding instead to play only said second card game.

2. The method of claim 1 wherein said dealer's up card is one of predetermined value i.e., ace card:

a) said player playing said first card game by optionally electing to be paid providing the sum of said players initial hand totals a predetermined value, said player having the total sum of both said initial wager and said optional wager paid according to conventional twenty-one play, and b) if said player placed said optional wager said player optionally enforcing said optional wager by deciding not to play said first card game and deciding instead to play said second card game which is stud poker, said dealer dealing said stud poker player one additional card only, said poker player combining said players initial hand and said additional card to form a three card hand, and c) said player optionally placing an insurance wager to insure said players wagers against said dealers initial community hand totaling a predetermined value, said insurance wager must be placed according to conventional twenty-one play, and d) said player optionally insuring either said initial wager only according to conventional twenty-one play, or said player optionally insuring both said wagers according to conventional twenty-one play.

3. The method of claim 2 wherein the combined total of said dealer's initial community hand totals a predetermined value, i.e., 21:

a) said dealer pushing said player if said players initial hand equals the same predetermined value as said dealers initial community hand according to conventional twenty-one play, and b) said players who placed said insurance wagers will be paid according to conventional twenty-one play, and said optional wager to form a stud poker wager, and c) if said player decided to play stud poker, said dealer combining said dealer's initial community hand and said poker player's three card hand to form a five card stud poker hand, said dealer comparing said stud poker hand with a predetermined set of poker hands, and d) if said stud poker hand is one of predetermined hands paying said player according to a preset poker hand payout schedule, and e) if said stud poker hand is not one of predetermined handsets said dealer collecting said player's wagers, and f) if the combined total of said dealer's initial community hand does not total a predetermined value, i.e., 21 said dealer collecting said insurance wagers.

4. The method of claim 1 wherein said dealer's up card is not one of predetermined value i.e., ace card:

a) and if said player placed said optional wager said player optionally enforcing said optional wager by deciding not to play said first card game and deciding instead to play said second card game which is stud poker, said dealer dealing said stud poker player one additional card only, said poker player combining said players initial hand and said additional card to form a three card hand, said stud poker player combining said initial wager and said optional wager to form a stud poker wager, and b) if said player placed said optional wager and if said player deciding to play twenty-one, said twenty-one player surrendering said optional wager, and c) said twenty-one player optionally exercising any options currently available under the rules of conventional twenty-one play, and d) said twenty-one player forming a players twenty-one hand using said players initial hand and additional cards, if additional cards are required, and e) said dealer dealing additional dealer cards as required under the rules of conventional twenty-one play, said dealer forming a dealers twenty-one hand from said dealers community hand and said additional dealer cards, and f) if said player placed said optional wager, said dealer form a five card stud poker hand from comparing said dealer's community hand and said poker player's three card hand, g) if said stud poker hand is one of predetermined hand set said stud poker players stud poker wager paying according to a preset poker hand payout schedule, and h) if said stud poker band is not one of predetermined hand set said dealer will collect said stud poker players stud poker wager, and I) said dealer comparing said dealer's twenty-one hand with said twenty-one player's twenty-one hand, and j) if said twenty-one player's hand is superior in value as opposed to said dealer's twenty-one hand, said dealer paying said twenty-one player according to conventional twenty-one play, and k) if said twenty-one players hand is inferior in value as opposed to said dealer's twenty-one hand said dealer collecting said twenty-one player's wager.

5. The method of claim 1, wherein:

a) representing said dealer by a computer capable of reproducing said dealer's likeness, b) representing said playing cards by a computer capable of reproducing said playing cards, and c) calculating said wagers through the deduction of money or addition of money in an account monitored by a computer.

* * * * *